US009918521B1

(12) United States Patent
Fink

(10) Patent No.: US 9,918,521 B1
(45) Date of Patent: Mar. 20, 2018

(54) ADJUSTABLE BUCKLE

(71) Applicant: Fastech, Inc., Canton, MA (US)

(72) Inventor: Matthew Fink, Weston, MA (US)

(73) Assignee: Fastech, Inc., Canton, MA (US)

( * ) Notice: Subject to any disclaimer, the term of this patent is extended or adjusted under 35 U.S.C. 154(b) by 2 days.

(21) Appl. No.: 14/630,344

(22) Filed: Feb. 24, 2015

(51) Int. Cl.
*A44B 11/04* (2006.01)
*B05D 7/00* (2006.01)
*A44B 11/02* (2006.01)

(52) U.S. Cl.
CPC ..... *A44B 11/04* (2013.01); *A44B 11/02* (2013.01); *B05D 7/5483* (2013.01)

(58) Field of Classification Search
CPC ..... A44B 11/04; A44B 11/02; B05D 7/5483
See application file for complete search history.

(56) References Cited

U.S. PATENT DOCUMENTS 2,066,914 A * 1/1937 Staples ..... A44B 11/04 24/163 FC
5,005,910 A * 4/1991 Itkis ..... A44B 11/10 24/170
5,590,443 A 1/1997 Fildan
2009/0133231 A1* 5/2009 Vogelsang ..... A44B 19/26 24/386
2014/0069352 A1* 3/2014 Fidrych ..... A01K 27/00 119/858
2014/0304898 A1* 10/2014 Bachtold ..... A44B 11/04 2/336

OTHER PUBLICATIONS http://www.sewsassy.com/BraProducts/braringsslideshooks.html, retrieved on Dec. 1, 2014.
http://www.etrailer.com/acessoriesandparts/yakima/Y04048.html, retrieved on Dec. 1, 2014.

* cited by examiner

*Primary Examiner* — Robert Sandy
*Assistant Examiner* — Louis A Mercado
(74) *Attorney, Agent, or Firm* — Pryor Cashman LLP

(57) ABSTRACT

An adjustable buckle for a strap includes a slider, a nylon coating disposed on the slider, and an anti-slip coating such as rubber disposed on the nylon coating. The slider is configured to be attached to a strap.

21 Claims, 2 Drawing Sheets

ADJUSTABLE BUCKLE

TECHNICAL FIELD

The present invention relates generally to buckles for straps, and particularly to buckles with an anti-slip feature that prevents loosening of the straps.

BACKGROUND OF THE INVENTION

Buckles for straps are known in the art. In particular, buckles in the form of tri-bar sliders, rings and g-shaped hooks are commonly used with straps for garments such as fabric shoulder straps on women's brassieres. Such buckles may be attached to two ends of a garment strap and are slidable to adjust the fit of the garment on its wearer. Such buckles, however, may slide and move with respect to a strap made of a smooth material such as a smooth fabric, knitted elastic or ribbon, which results in loosening of the strap over the course of a day that the garment is worn. The present invention represents an improved buckle for straps that prevents loosening of the straps once the buckle has been moved into place.

SUMMARY OF THE INVENTION

It is an object of the present invention to provide an adjustable buckle for a strap that prevents loosening of the strap once the buckle has been moved into place. The invention is applicable to any application that requires an adjustable buckle for a strap. For example, the present invention is applicable to the field of apparel, such as an adjustable buckle for a smooth material shoulder strap including a movable tri-bar slider, ring or g-shaped hook attached to two ends of the strap.

In general, in one aspect, the invention features an adjustable buckle, including a slider, a nylon coating disposed on the slider, and an anti-slip coating disposed on the nylon coating.

Implementations of the invention may include one or more of the following features. The slider may be a tri-bar slider, a ring or a g-shaped hook. The slider may be configured to be attached to a strap. The anti-slip coating may include rubber. The slider may be formed from metal, which may include steel, stainless steel, copper, brass, zinc alloy, or a combination of any these. The slider may be formed from plastic. The nylon coating may have a smooth finish. The anti-slip coating may have a tacky finish.

In general, in another aspect, the invention features an adjustable buckle, including a slider having a first bar with first and second ends, a second bar with first and second ends and disposed substantially parallel to the first bar, and a third bar with first and second ends and disposed substantially parallel to the first bar, a first pair of arms fixedly connecting the first ends and the second ends of the first bar and the second bar to form a first loop, and a second pair of arms fixedly connecting the first ends and the second ends of the first bar and the third bar to firm a second loop. A nylon coating is disposed on the slider, and an anti-slip coating is disposed on the nylon coating.

Implementations of the invention may include one or more of the following features. The first bar, the second bar and the third bar may substantially lie in a plane. The slider may be configured to be attached to a strap. The anti-slip coating may include rubber. The slider may be formed from metal, which may include steel, stainless steel, copper, brass, zinc alloy, or a combination of any these. The slider may be formed from plastic. The nylon coating may have a smooth finish. The anti-slip coating may have a tacky finish.

In general, in another aspect, the invention features a method of making an adjustable buckle, including providing a slider, forming a nylon coating on the slider, and forming an anti-slip coating on the nylon coating.

Implementations of the invention may include one or more of the following features. Forming the anti-slip coating may include depositing a layer of rubber. Forming the nylon coating may include making a smooth finish.

BRIEF DESCRIPTION OF THE FIGURES

The above-mentioned and other aspects, features and advantages can be more readily understood from the following detailed description with reference to the accompanying drawings wherein.

DETAILED DESCRIPTION OF THE INVENTION

Figure 1:
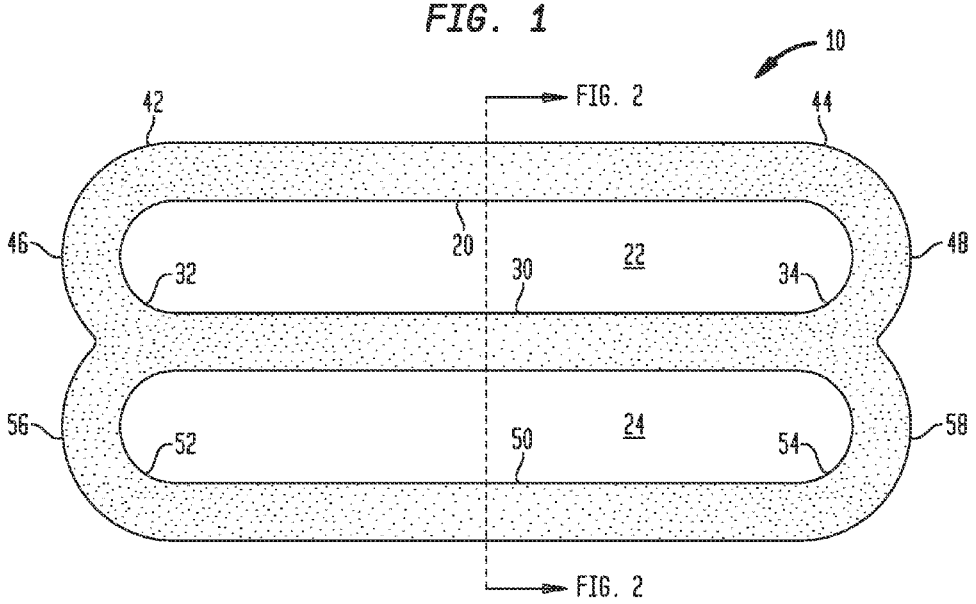
FIG. 1 shows a plane view of an adjustable buckle according to an embodiment of the present invention.

FIG. 1 shows a buckle 10 according to the present invention. Buckle 10 includes a slider 20 such as a tri-bar slider. In one embodiment, slider 20 includes a first bar 30 with first and second ends 32 and 34. A second bar 40 has first and second ends 42 and 44 and is disposed substantially parallel to first bar 30. A third bar 50 has first and second ends 52 and 54 and is also disposed substantially parallel to first bar 30. A first pair of arms 46 and 48 fixedly connect first and second ends 32 and 34 of first bar 30 and first and second ends 42 and 44 of second bar 40 to form a first loop 22. A second pair of arms 56 and 58 fixedly connect first and second ends 32 and 34 of first bar 30 and first and second ends 52 and 54 of third bar 50 to form a second loop 24.

First bar 30, second bar 40 and third bar 50 may lie in substantially the same plane, or they may be placed in any configuration that provides for the formation of first loop 22 and second loop 24 so that buckle 10 may function as an adjustable buckle.

Slider 20 may have the form of any buckle for an adjustable strap, such as a tri-bar slider, a ring or a g-shaped hook. Slider 20 may be made of any durable, non-bendable and strong material, such as metal or plastic. Acceptable metals include steel, stainless steel, copper, brass, zinc alloy, or a combination of any of these metals.

Figure 2:
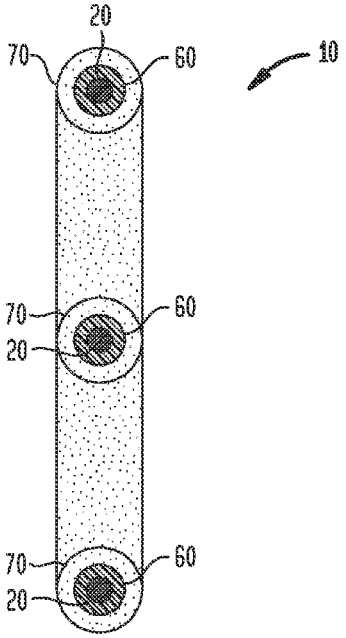
FIG. 2 shows a side view of the adjustable buckle of FIG. 1 cut along line A-A.

As shown in FIG. 2, buckle 10 includes a nylon coating 60 disposed on slider 20. Nylon coating 60 may be formed on slider 20, e.g., by spraying a nylon material on the slider or by dipping the slider in a liquid nylon material that dries and affixes to the slider. Nylon coating 60 may have a smooth finish to allow a further coating to be disposed or formed thereon.

Buckle 10 further includes an anti-slip coating 70 disposed on nylon coating 60. Anti-slip coating 70 may be formed from rubber, and may have a tacky finish. Anti-slip coating 70 provides a frictive force that prevents buckle 10 from moving along a smooth material such as a smooth fabric strap. Anti-slip coating 70 may be formed on slider 20, e.g., by spraying an anti-slip or rubber material on the nylon coating or by dipping the slider with the nylon coating in a liquid anti-slip material such as rubber that dries and affixes to the nylon coating.

The combination of nylon coating 60 and anti-slip coating 70 permit buckle 10 to withstand repeating washing as part of a garment, such as with a standard washing machine, while maintaining its anti-slip feature. An anti-slip coating such as rubber is better able to withstand repeated washings when it is disposed on a nylon surface rather than on a raw metal surface of the slider.

Figure 3:
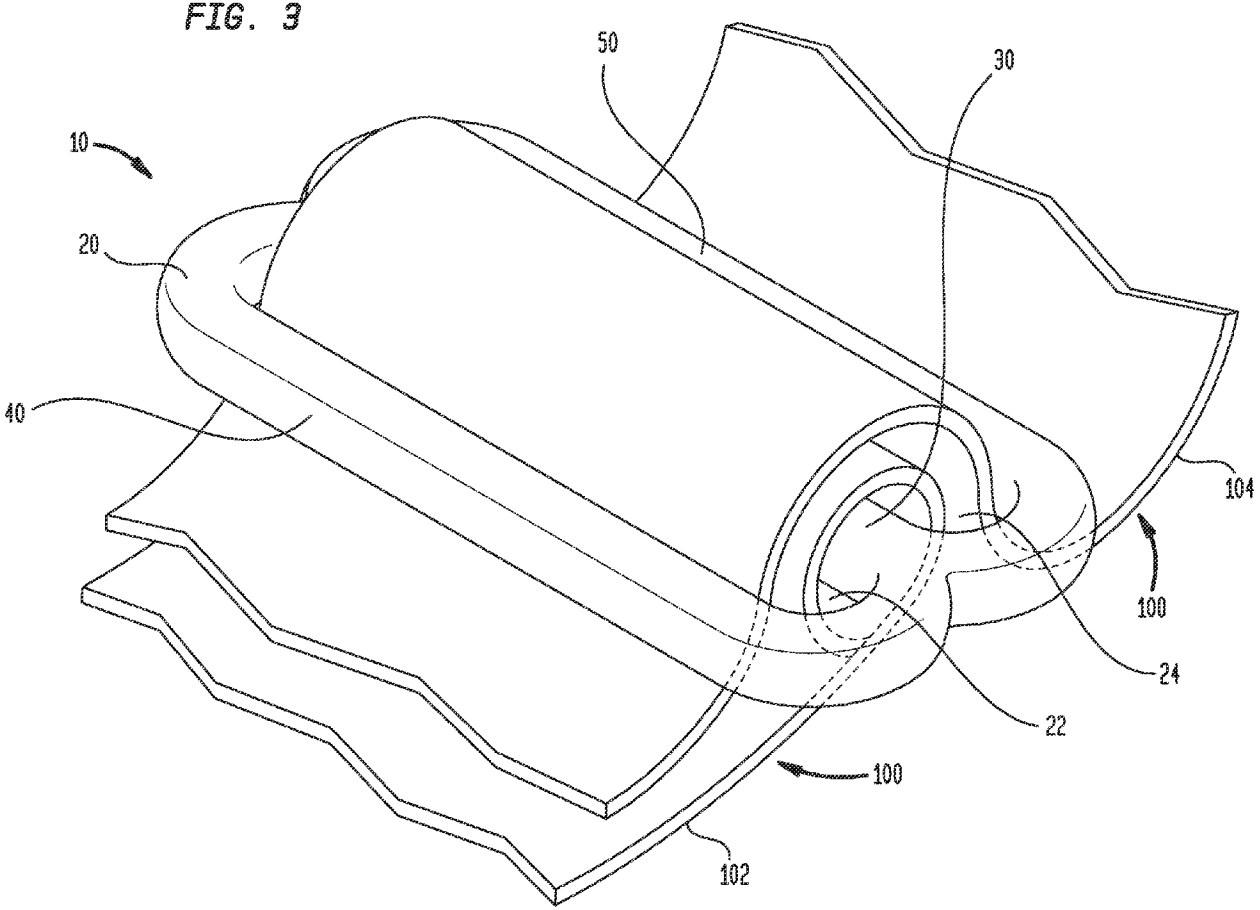
FIG. 3 shows a perspective view of the adjustable buckle of FIG. 1 attached to a strap.

As shown in FIG. 3, buckle 10 may be attached to ends 102 and 104 of strap 100. In the configuration shown in FIG. 3, end 102 of strap 100 is attached to first bar 30 of slider 20 by a fixed loop. End 104 of strap 100 is threaded in loop 22 under second bar 40, over first bar 30, and in loop 24 under third bar 50. In this configuration, buckle 10 is movable along strap 100 to adjust the relative lengths of ends 102 and 104, i.e., to adjust the length of strap 100. Slider 20 is configured to firmly hold ends 102 and 104 of strap 100 against each other when moved into an adjusted position. Anti-slip coating 70 on slider 20 provides a frictive force that prevents buckle 10 from slipping with respect to smooth fabric strap 100. Such an adjustment of a strap by sliding a buckle along the strap is common with shoulder straps on women's brassieres.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty that characterize the invention, are pointed out with particularity in the claims annexed hereto and forming a part of this disclosure. For an understanding of the invention, its operating advances and the specific objects attained by its uses, reference should be had to the accompanying drawings and descriptive matter in which there is illustrated a preferred embodiment of the invention.

What is claimed is:

1. An adjustable buckle, comprising:
a slider;
a nylon coating disposed on the slider; and
an anti-slip coating disposed on the nylon coating,
wherein the anti-slip coating is contiguous with the nylon coating.

2. The adjustable buckle of claim 1 wherein the slider is a tri-bar slider.

3. The adjustable buckle of claim 1 wherein the slider is configured to be attached to a strap.

4. The adjustable buckle of claim 1 wherein the anti-slip coating comprises rubber.

5. The adjustable buckle of claim 1 wherein the slider is formed from metal.

6. The adjustable buckle of claim 5 wherein the metal comprises steel, stainless steel, copper, brass, zinc alloy, or a combination of any these.

7. The adjustable buckle of claim 1 wherein the slider is formed from plastic.

8. The adjustable buckle of claim 1 wherein the nylon coating has a smooth finish.

9. The adjustable buckle of claim 1 wherein the anti-slip coating has a tacky finish.

10. An adjustable buckle, comprising:
a slider having a first bar with first and second ends, a second bar with first and second ends and disposed substantially parallel to the first bar, and a third bar with first and second ends and disposed substantially parallel to the first bar, a first pair of arms fixedly connecting the first ends and the second ends of the first bar and the second bar to form a first loop, and a second pair of arms fixedly connecting the first ends and the second ends of the first bar and the third bar to firm a second loop;
a nylon coating disposed on the slider; and
an anti-slip coating disposed on the nylon coating,
wherein the anti-slip coating is contiguous with the nylon coating.

11. The adjustable buckle of claim 10 wherein the first bar, the second bar and the third bar substantially lie in a plane.

12. The adjustable buckle of claim 10 wherein the slider is configured to be attached to a strap.

13. The adjustable buckle of claim 10 wherein the anti-slip coating comprises rubber.

14. The adjustable buckle of claim 10 wherein the slider is formed from metal.

15. The adjustable buckle of claim 14 wherein the metal comprises steel, stainless steel, copper, brass, zinc alloy, or a combination of any these.

16. The adjustable buckle of claim 10 wherein the slider is formed from plastic.

17. The adjustable buckle of claim 10 wherein the nylon coating has a smooth finish.

18. The adjustable buckle of claim 10 wherein the anti-slip coating has a tacky finish.

19. A method of making an adjustable buckle, comprising:
providing a slider;
forming a nylon coating on the slider; and
forming an anti-slip coating on the nylon coating,
wherein the anti-slip coating is contiguous with the nylon coating.

20. The method of claim 19 wherein forming the anti-slip coating comprises depositing a layer of rubber.

21. The method of claim 19 wherein forming the nylon coating comprises making a smooth finish.

* * * * *